US008241063B2

(12) United States Patent
Nagata et al.

(10) Patent No.: US 8,241,063 B2
(45) Date of Patent: Aug. 14, 2012

(54) CONNECTOR HAVING A BODY WITH A POSITIONING PROJECTION ENGAGING A POSITIONING DEPRESSION ON A SHIELD CASE

(75) Inventors: Takayuki Nagata, Yao (JP); Takahisa Ohtsuji, Yao (JP)

(73) Assignee: Hosiden Corporation, Yao-Shi (JP)

( * ) Notice: Subject to any disclaimer, the term of this patent is extended or adjusted under 35 U.S.C. 154(b) by 0 days.

(21) Appl. No.: 13/043,851

(22) Filed: Mar. 9, 2011

(65) Prior Publication Data

US 2011/0237107 A1 Sep. 29, 2011

(30) Foreign Application Priority Data

Mar. 26, 2010 (JP) ..... 2010-072566

(51) Int. Cl.
*H01R 13/648* (2006.01)
*H01R 4/50* (2006.01)
*H01R 13/64* (2006.01)

(52) U.S. Cl. ..... 439/607.01; 439/345; 439/680

(58) Field of Classification Search ..... 439/607.01, 439/607.23, 607.4, 79, 541.5
See application file for complete search history.

(56) References Cited

U.S. PATENT DOCUMENTS

| | | | | |
|---|---|---|---|---|
| 5,772,453 | A | 6/1998 | Tan et al. | |
| 7,044,779 | B1 * | 5/2006 | Liu | 439/541.5 |
| 7,192,297 | B1 * | 3/2007 | Wu | 439/358 |
| 7,402,078 | B2 * | 7/2008 | Wan et al. | 439/607.01 |
| 7,588,458 | B2 * | 9/2009 | He et al. | 439/541.5 |
| 7,604,490 | B2 * | 10/2009 | Chen et al. | 439/79 |
| 7,651,371 | B2 * | 1/2010 | Yi et al. | 439/541.5 |
| 7,731,535 | B1 * | 6/2010 | Wan et al. | 439/607.4 |
| 7,758,380 | B2 * | 7/2010 | Wang et al. | 439/607.23 |
| 7,997,927 | B2 * | 8/2011 | Wan et al. | 439/541.5 |
| 2005/0118876 | A1 | 6/2005 | Niitsu | |
| 2009/0149045 | A1 | 6/2009 | Chen et al. | |
| 2010/0062653 | A1 | 3/2010 | Mao et al. | |

FOREIGN PATENT DOCUMENTS

| | | | |
|---|---|---|---|
| EP | 2 120 299 | A2 | 11/2009 |
| JP | 2004-537836 | A1 | 12/2004 |
| WO | WO 03/012928 | A1 | 2/2003 |
| WO | WO 03/028169 | A1 | 4/2003 |

OTHER PUBLICATIONS

Extended European Search Report issued on Jul. 25, 2011 for counterpart European patent application No. 11250384.2.

* cited by examiner

*Primary Examiner* — Chandrika Prasad
(74) *Attorney, Agent, or Firm* — Kratz, Quintos & Hanson, LLP

(57) ABSTRACT

The invention provides a connector including: a shield case having first and second slots; first and second bodies, inserted into the case and combined in an insertion direction; first and second contacts embedded in the first body at spaced intervals in a width direction; and third and fourth contacts embedded in the second body at spaced intervals in the width direction and at a different height from that of the first and second contacts. The first and third contacts are partly received in the first slot. The second and fourth contacts are partly received in the second slot. The case has a partition to partition an internal space thereof into the first and second slots, and a lock piece provided at a rear portion of the case. The first and second bodies are sandwiched between the partition and the lock piece.

14 Claims, 14 Drawing Sheets

CONNECTOR HAVING A BODY WITH A POSITIONING PROJECTION ENGAGING A POSITIONING DEPRESSION ON A SHIELD CASE

The present application claims priority under 35 U.S.C. §119 of Japanese Patent Application No. 2010-072566 filed on Mar. 26, 2010, the disclosure of which is expressly incorporated by reference herein in its entity.

BACKGROUND OF THE INVENTION

1. Technical Field

The present invention relates to a connector, used as a receptacle or a plug, and electronic equipment including the same connector.

2. Background Art

Generally speaking, as one receptacle connector corresponds to one plug connector, the connection of two types of plug connectors should require two receptacle connectors. The two receptacle connectors should thus take a large mounting space on a circuit board. Moreover, mounting receptacle connectors separately on the circuit board lead to increased assembling man-hours and further to increased cost. Moreover, mounting positions of the receptacle connectors may vary, causing unevenness in the dimension between the two receptacle connectors.

Moreover, some conventional receptacle connectors have contacts incorporated in its body in two (upper and lower) rows, by press fitting or by insert molding, as disclosed in Patent Literature 1. The press fitting method is unfavorable in fabricating small connectors due to poor workability in incorporating the contacts and low accuracy in positioning the contacts. The insert molding method is more favorable in fabricating small connectors because of better workability in incorporating the contacts, higher accuracy in positioning the contacts, and reduced costs. Nevertheless, insert molding processing has problems in fabricating further downsized connectors, e.g., difficulty in reserving enough thickness of insulating resin (body) to embed the upper and lower contacts.

These problem may be solved in a connector as disclosed in Patent Literature 2. Particularly, a body of the connector is divided into first and second bodies, and first contacts are embedded in the first body, and second contacts are embedded in the second body by the insert molding, and then, the first and second bodies are combined to array the first and second contacts in two upper and lower rows. In this manner, insert-molding the first and second contacts in the two (first and second) bodies brings about the thickness to hold the first and second contacts in the first and second bodies.

CITATION LIST

Patent Literature 1: WO2003/028169 (also published as US2005118876A)

Patent Literature 2: JP 2004-537836 A (also published as WO03/012928)

SUMMARY OF INVENTION

However, there is another problem in the connector having the first and second bodies: the difficulty in fix the combined first and second bodies in position inside the shield case. The first and second bodies are apt to be displaced inside the shield case, resulting inferior accuracy in positioning the first and second contacts.

The present invention is devised in light of the above-described situation. The invention provides a connector that is adapted for connection with at least two mating connectors and has first and second bodies and first and second contacts that can be fixed accurately in position inside a shield case. The invention also electronic equipment incorporated with such connector.

A connector of the present invention includes: a tuboid shield case having first and second slots; first and second bodies, inserted into the shield case and combined anteroposteriorly in an insertion direction of the first and second bodies; a plurality of first contacts embedded in the first body at spaced intervals in a width direction of the first body, the first contacts each partly being received in the first slot; a plurality of second contacts embedded in the first body at spaced intervals in the width direction, the second contacts each partly being received in the second slot; a plurality of third contacts embedded in the second body at spaced intervals in the width direction and at a different height from that of the first contacts, the third contacts each partly being received in the first slot; and a plurality of fourth contacts embedded in the second body at spaced intervals in the width direction and at a different height from that of the second contacts, the fourth contacts each partly being received in the second slot. The shield case has a partition to partition an internal space thereof into the first and second slots, and a lock piece provided at a rear portion of the shield case. The partition is abuttable on a front surface of the first body. The lock piece is abuttable on a rear surface of the second body so as to sandwich the first and second bodies between the partition and the lock piece.

In the above-described connector, the partition of the shield case partitions the internal space of the shield case into the first and second slots, which are adapted to receive and be connected with two mating connectors. As two connectors are thus integrated into the present connector, it is possible to reduce a mounting space on the circuit board as compared with a case where two separate connectors are used, and it is also possible to reduce the number of components and assembling man-hours. In addition, the present connector is free from the problem of unevenness in mounting position on the circuit board that is likely to arise when mounting two separate connectors. Further, the first and second contacts are embedded in the first body, the third and fourth contacts are embedded in the second body, and the first and second bodies are combined anteroposteriorly in the insertion direction, by which the first contacts and the third contacts are arranged at the different height positions, and the second contacts and the fourth contacts are arranged at the different height positions. Accordingly, even when the present connector is downsized, the first body can have enough thickness to embed and hold the first and second contacts therein, the second body can have enough thickness to embed and hold the third and fourth contacts therein, so that the invention makes it possible to array with high accuracy the first and second contacts in the first body and the third and fourth contacts in the second body. Moreover, it is advantageously easy to fix the first and second bodies in position inside the shield case because the first and second bodies are securely sandwiched between the partition and the lock piece of the shield case. It is therefore possible to avoid the displacement of the first and second bodies inside the shield case and thereby ensure accuracy in positioning the first, second, third, and fourth contacts. It is also advantageously easy to incorporate the combined first and second bodies in the shield case because the front surface of the first body is simply brought into abutment with the partition of the shield case and the rear surface of the second body is simply brought into abutment with the lock piece.

A fitting projection may be provided in a rear surface of the first body and a fitting depression may be provided in a front surface of the second body; or, alternatively, a fitting depression may be provided in a rear surface of the first body and a fitting projection may be provided in a front surface of the second body. The fitting projection may be adapted to fit in the fitting depression in a state where the first and second bodies are combined. Accordingly, simply by fitting the fitting projection in the fitting depression, the first and second bodies as combined are fixed in position, the first and third contacts are fixed at the different height positions and the second and fourth contacts are fixed at the different height positions. The invention thus makes it possible to improve the stability of the positioning accuracy of the first, second, third, and fourth contacts.

The shield case may further have a top plate, a bottom plate and a pair of side plates. The bottom plate may have a shorter length in the insertion direction than that of the top plate. The bottom plate may have a central portion bent toward the top plate, the central portion serving as the partition. The partition of the invention can be formed with ease, simply by bending the central portion of the bottom plate toward the top plate.

An outer surface of the central portion of the bottom plate may be provided with a positioning depression. Alternatively, the outer surface of the central portion of the bottom plate may be provided with a positioning depression that is formed by bending the central portion. The front surface of the first body may be provided with a positioning projection that may be fittingly engageable with the positioning depression. In this case, fitting the positioning projection in the positioning depression allows the first body to be positioned and fixed to the shield case. In this manner, with the first body is fixed in position, the first and second bodies can be securely sandwiched by the partition and the lock piece. Consequently, the invention makes it possible to improve the positioning accuracy of the first and seconds bodies inside the shield case and the positioning accuracy of the first, second, third, and fourth contacts.

If the positioning depression extends in the insertion direction, the positioning depression may be adapted to guide the positioning projection of the first body when the first body is inserted into the shield case. By virtue of the positioning depression guiding the positioning projection, it is easy to insert the first body in position in the shield case. The invention thus makes it possible to improve the positioning accuracy of the first and second bodies inside the shield case, and to improve the positioning accuracy of the first, second, third, and fourth contacts.

A rear surface of the bottom plate may preferably be abuttable on the front surface of the first body. In this case, in addition to the partition, the rear surface of the bottom plate abuts the front surface of the first body. The invention thus makes it possible to improve the positioning accuracy of the first and second bodies inside the shield case, and to improve the position accuracy of the first, second, third, and fourth contacts.

The top plate may be provided with an abutting-stop projected toward the bottom plate. The abutting-stop may be abuttable on the first body from a front side of the connector. In this case, in addition to the partition, the abutting-stop abuts on the first body from the front side. The invention thus makes it possible to improve the positioning accuracy of the first and second bodies inside the shield case, and to improve the position accuracy of the first, second, third, and fourth contacts.

The first body may preferably be abuttable at least two points on the top plate. If the first body abuts at least two points on the top plate, the parallelism of the first body and the second body combined with the same in relation to the top plate is improved. As a result, it is possible to improve the positioning accuracy of the first and second bodies inside the shield case, and to improve the position accuracy of the first, second, third, and fourth contacts.

The lock piece may be lock pieces provided continuously to respective rear ends of the side plates. The lock pieces as extending straight along the side plates may guide the first and second bodies when being inserted in the shield case. The lock pieces as bent may be abuttable on the rear surface of the second body. In this case, the lock pieces functions not only as locking members to securely sandwich the first and second bodies between the partition and themselves, but also as guiding members to guide the first and second bodies into the shield case, the configuration of the shield case can be simplified as compared with a case where guide members are separately provided in the shield case. Thus, the invention can lower the cost of the connector.

The first body may include a main body of generally rectangular shape in cross-sectional view; first and second projected portions projected from a front surface of the main body and adapted to be received in the first and second slots, respectively; and a protruded portion provided on a lower surface of the main body and abuttable on the rear surface of the bottom plate. First and second long grooves extending in the insertion direction may be formed in lower surfaces of the first and second projected portions, respectively. Third and fourth long grooves extending in the insertion direction may be formed in upper surfaces of the first and second projected portions, respectively. The main body may have first and second holes passing through the main body in the insertion direction and communicating with the third and fourth long grooves, respectively. The third and fourth contacts may each have an embedded portion that is embedded in the second body; a contact portion that continues to an lengthwise end of the embedded portion and is received in an associated one of the first and second holes and an associated one of the third and fourth long grooves; and a tail portion that continues to the other lengthwise end of the embedded portion. The first and second contacts may each have an embedded portion that is embedded in the main body; a contact portion that continues to an lengthwise end of the embedded portion and is received in an associated one of the first and second long grooves of the first and second projected portions; and a tail portion that continues to the other lengthwise end of the embedded portion.

In the case where the connector is a receptacle connector, the tail portions of the first and third contacts may be arranged at a same height and in two anteroposterior rows in the insertion direction, and the tail portions of the second and fourth contacts are arranged a same height and in two anteroposterior rows in the insertion direction. Alternatively, if the contact portions of the first and third contacts are arranged in a zigzag manner, the contact portions of the second and fourth contacts are arranged in a zigzag manner, the tail portions of the first, second, third and fourth contacts may be arranged at a same height and in a row in the width direction. Still alternatively, the tail portions may be extended downward.

In the case of a receptacle connector mountable on a circuit board, the first body may preferably be provided with a locking projection adapted to be locked in a locking hole of the circuit board. In this case, locking the locking projection of the first body in the locking hole of the circuit board can increase the positioning accuracy of the first and second slots of the connector with respect to a plug receiving port of electronic equipment incorporating the present connector and the circuit board. Accordingly, the invention can reduce undue stress from being applied to the connector due to axial deviation in receiving plug connectors into the first and second slots.

Electronic equipment of the present invention includes the above-described connector as an external interface.

DESCRIPTION OF EMBODIMENTS

Figure 1A:
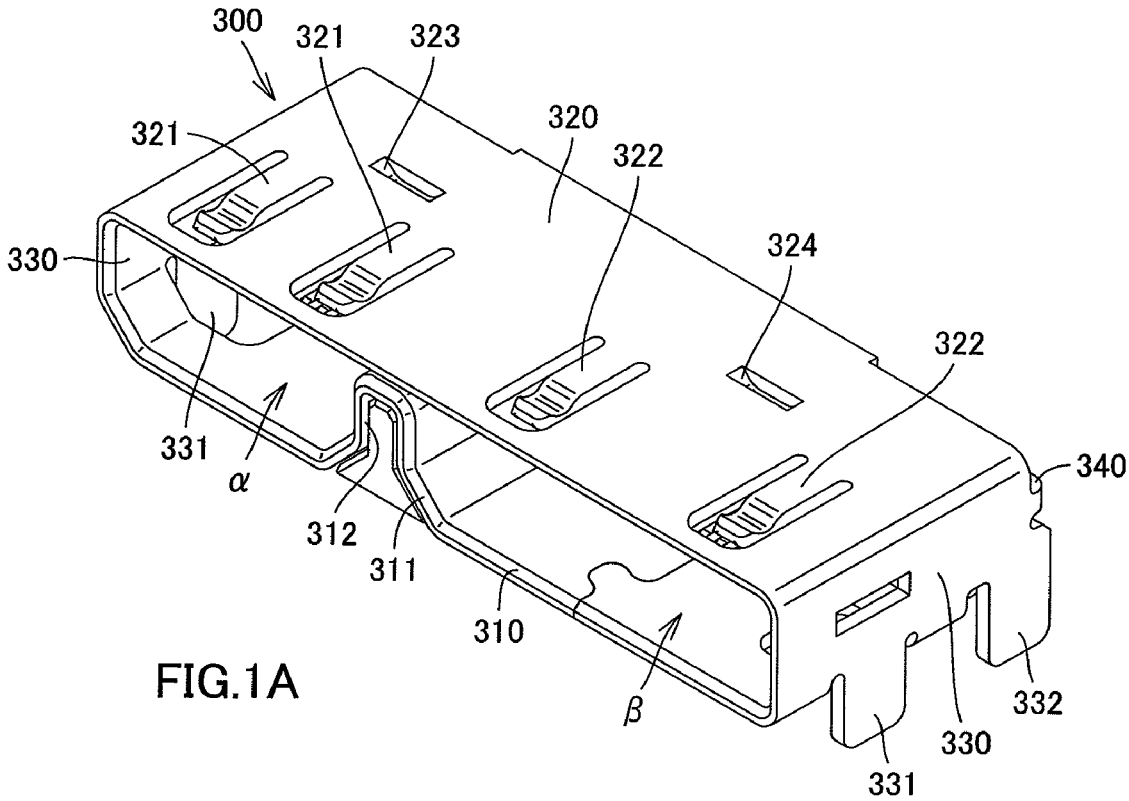
FIGS. 1A and 1B are perspective views of a connector according to a first embodiment of the present invention, FIG. 1A illustrating the connector as seen from the front, top and right side, and FIG. 1B illustrating the connector as seen from the back, bottom and right side.
Figure 1B:
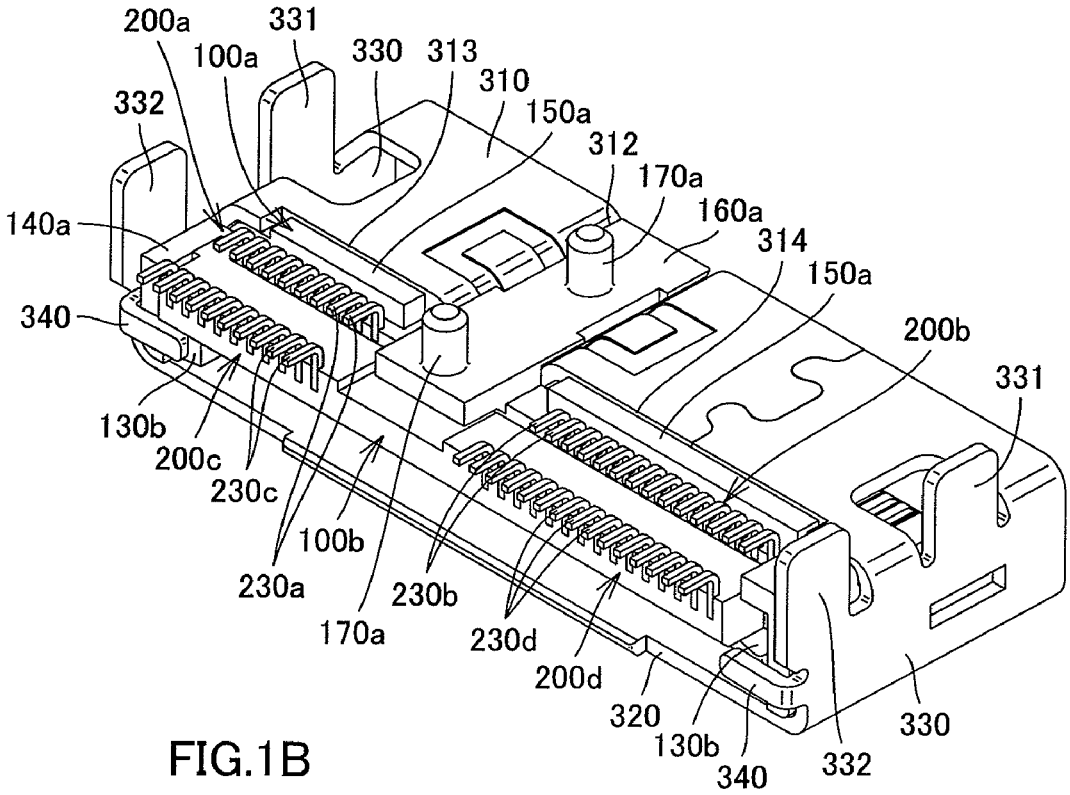

Hereinafter, first and second embodiments of the present invention will be described.

First Embodiment

First, a receptacle connector according to the first embodiment of the present invention will be described with reference to FIGS. 1A to 6C. The receptacle connector shown in FIGS. 1A to 3C is compliant with the HDMI (High-Definition Multimedia Interface) standard, to be mounted on a circuit board 10 of electronic equipment, such as a television receiver, and used as an external interface of the electronic equipment. The receptacle connector includes first and second bodies 100*a*, 100*b*, a plurality of first, second, third and fourth contacts 200*a*, 200*b*, 200*c*, and 200*d*, and a shield case 300. The respective elements of the connector will be described in detail below. It should be noted that the direction to insert the first and second bodies 100*a*, 100*b* into an accommodating space (to be described) is indicated as an insertion direction D in FIGS. 4 and 5.

The shield case 300 is fabricated by press-molding a conductive metal plate into a generally rectangular tube shape, as shown in FIGS. 1A to 5. The shield case 300 has a bottom plate 310, a top plate 320, a pair of side plates 330, and a pair of lock pieces 340. The bottom plate 310 is a generally rectangular plate opposed to the top plate 320. The bottom plate 310 and the top plate 320 are coupled at their widthwise ends with the side plates 330. The depth (i.e., length in the insertion direction D) of the bottom plate 310 is shorter than each depth of the top plate 320 and the side plates 330, as shown in FIGS. 3A to 3D. The bottom plate 310, and a front portion of the top plate 320, and front portions of the side plates 330 define an internal space of the shield case 300, and rear portions of the top plate 320 and the side plates 330 define the accommodating space for accommodating the first and second bodies 100*a*, 100*b* inserted from a rear side.

The bottom plate 310 is bent at a central portion into a generally inverted U shape extending toward the top plate 320. The bent central portion serves as a partition 311 having a generally inverted U-shaped cross section, which partitions the internal space into first and second slots α, β, and the outer surface of the central portion forms a positioning depression 312 having a generally inverted U-shaped cross section and extending in the insertion direction D. The positioning depression 312 consists of a rectangular upper depression 312*a* and a lower depression 312*b*. The distance between the opposite walls of the lower depression 312*b* are gradually increased toward the lower end. The first slot α has an inner shape conforming to an outer shape of a connection part 21 for HDMI-mini of a plug connector 20 shown in FIG. 6A or to a connection part 31 for HDMI-mini of a plug connector 30 shown in FIG. 6B. The second slot β has an inner shape conforming to an outer shape of a connection part 22 for HDMI of the plug connector 20 shown in FIG. 6A, or to a connection part 41 for HDMI of a plug connector 40 shown in FIG. 6C. That is, the first slot α is adapted to receive the connection part 21 or the connection part 31, and the second slot β is adapted to receive the connection part 22 or the connection part 41. Moreover, rear surfaces of the bottom plate 310, corresponding to first and second slot α and β, serve as abutting-stop surfaces 313, 314 to abut front surfaces of a pair of elongated protrusions 150*a* (to be described) of the first body 100*a* (see FIGS. 3B to 3D). It is appreciated that strength of the first and second slot α, β portions of the shield case 300 is ensured by providing a joint of the shield case 300 in the second slot β portion of the bottom plate 310 (see FIG. 2D).

Figure 4:
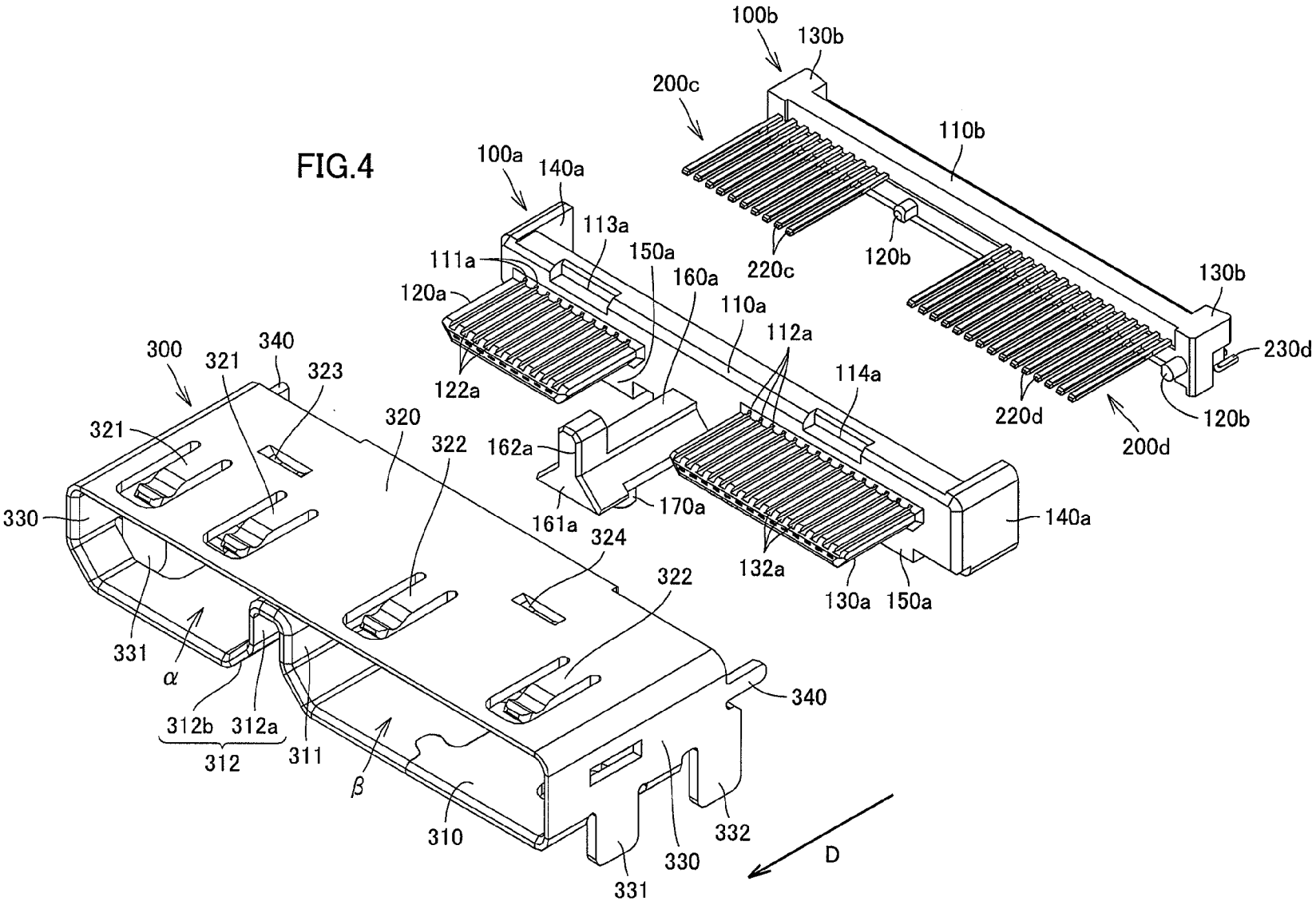
FIG. 4 is an exploded perspective view illustrating the connector as seen from the front, plan and right side.
Figure 5:
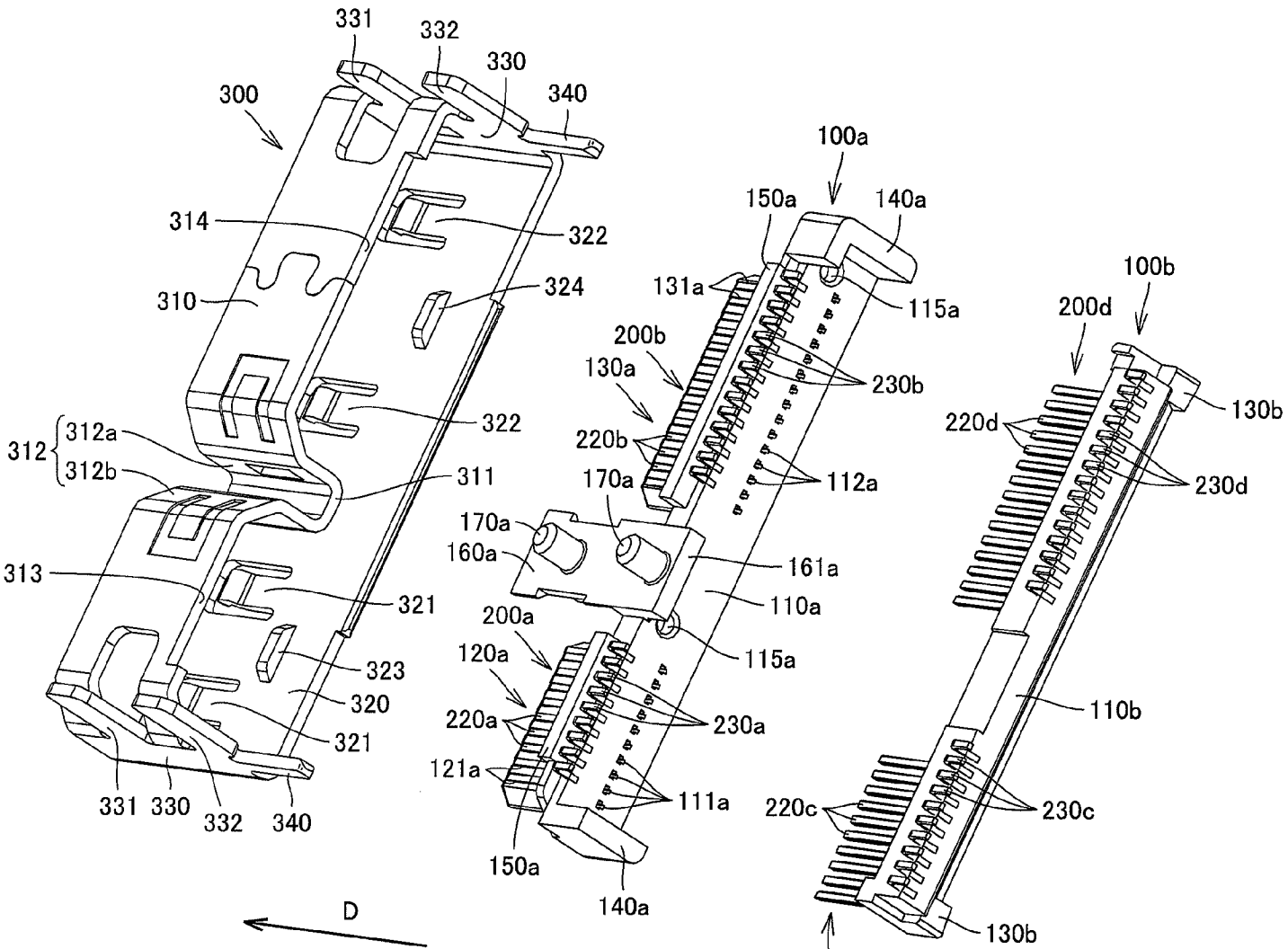
FIG. 5 is an exploded perspective view illustrating the connector as seen from the back, bottom and left side.
Figure 6A:
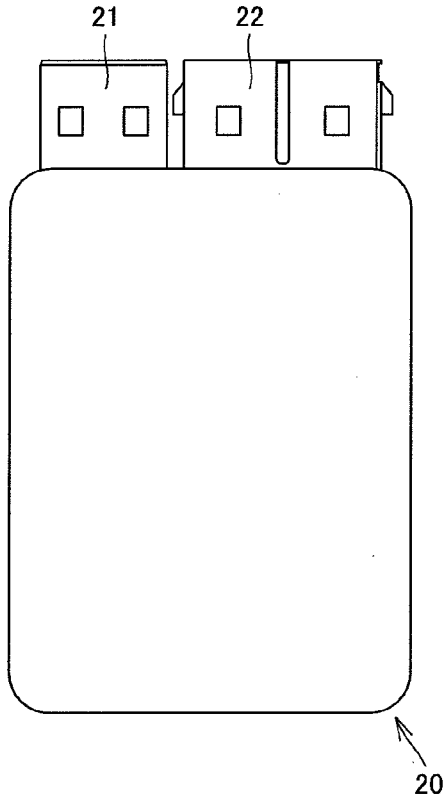
FIGS. 6A to 6C are plan views each showing a plug connector to be connected to the connector, FIG. 6A being a view showing plug connector of integral type, FIG. 6B being a view showing a plug connector of single type to be connected to a first slot of the connector, and FIG. 6C being a view showing a plug connector of single type to be connected to a second slot of the connector.
Figure 6B:
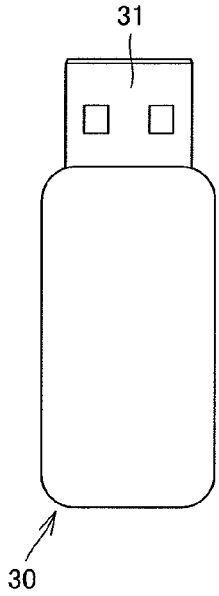
Figure 6C:
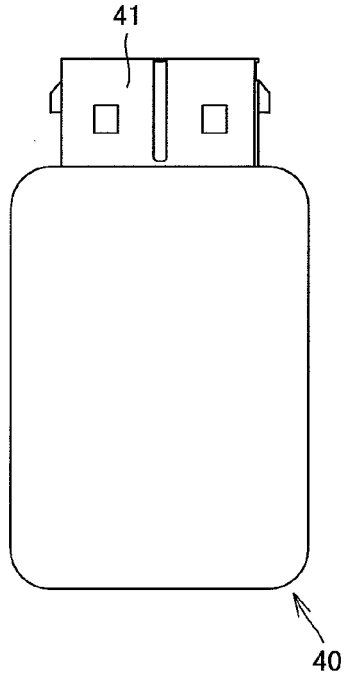
Figure 7A:
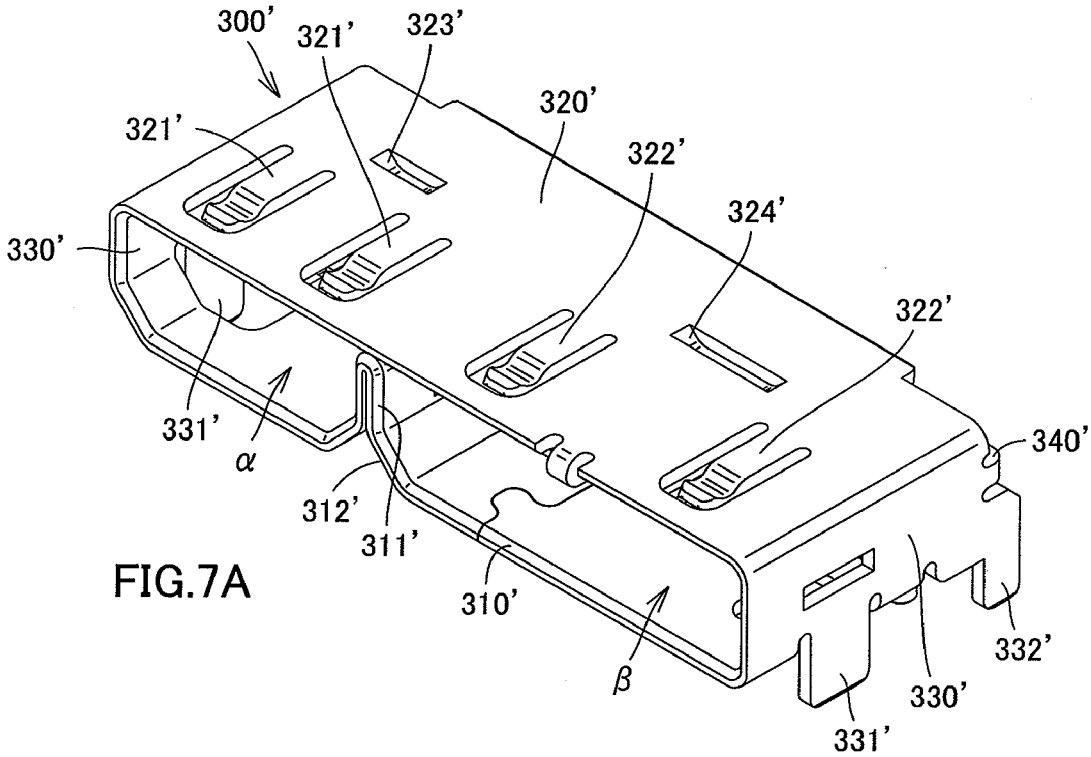
FIGS. 7A and 7B are perspective views of a connector according to a second embodiment of the present invention, FIG. 7A illustrating the connector as seen from the front, top and right side, and FIG. 7B illustrating the connector as seen from the back, bottom and right side.
Figure 7B:
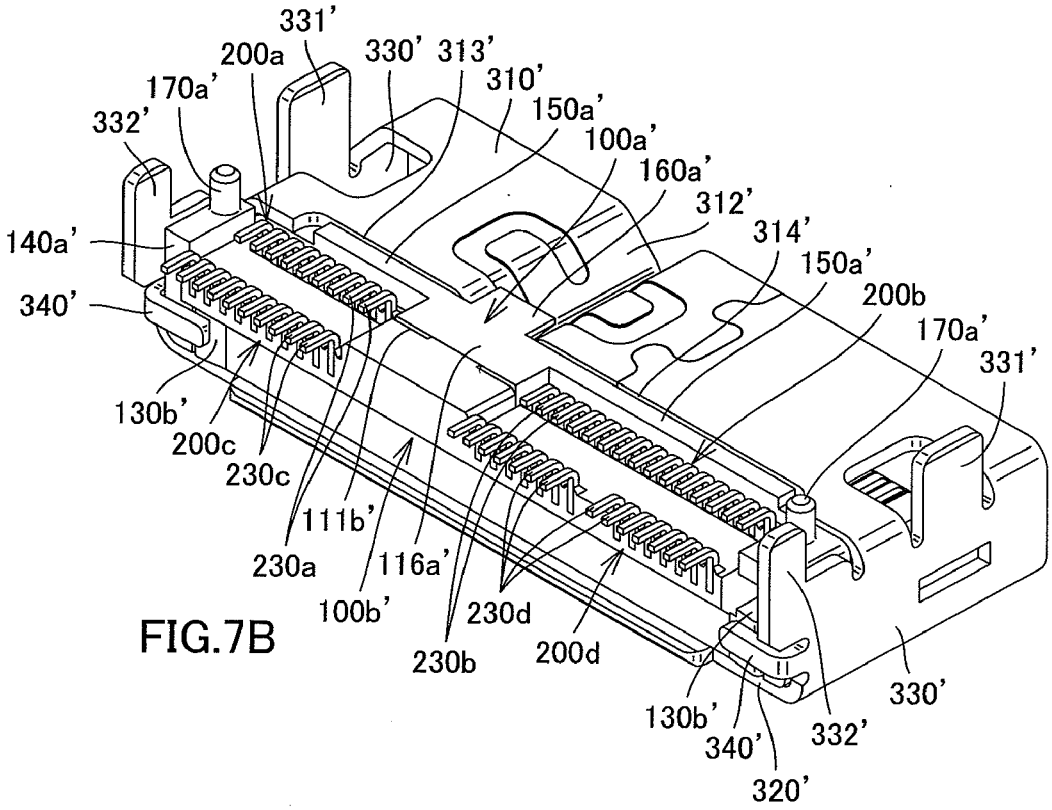
Figure 8A:
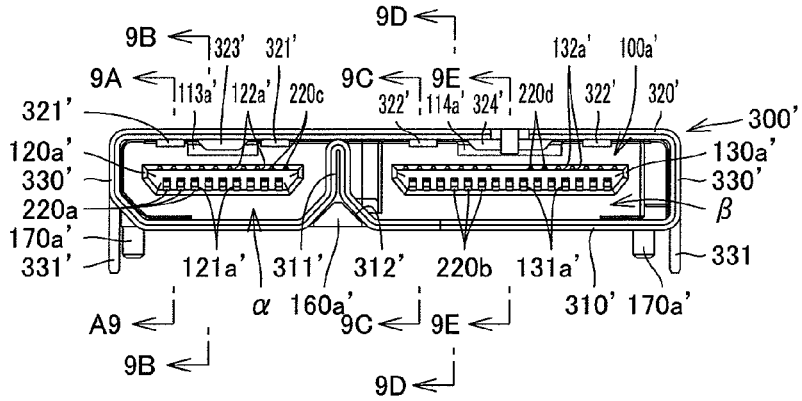
FIGS. 8A to 8F are schematic views of the connector, FIG. 8A being a front view, FIG. 8B being a back view, FIG. 8C being a plan view, FIG. 8D being a bottom view, FIG. 8E being a right side view, and FIG. 8F being a left side view.
Figure 8B:
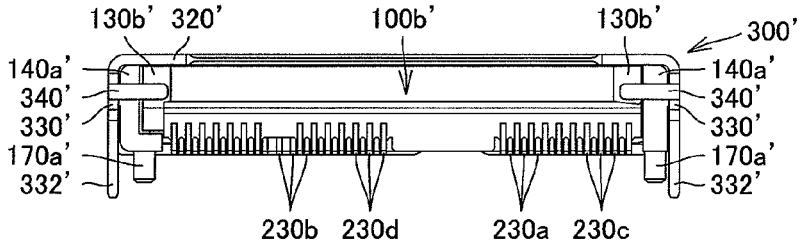
Figure 8C:
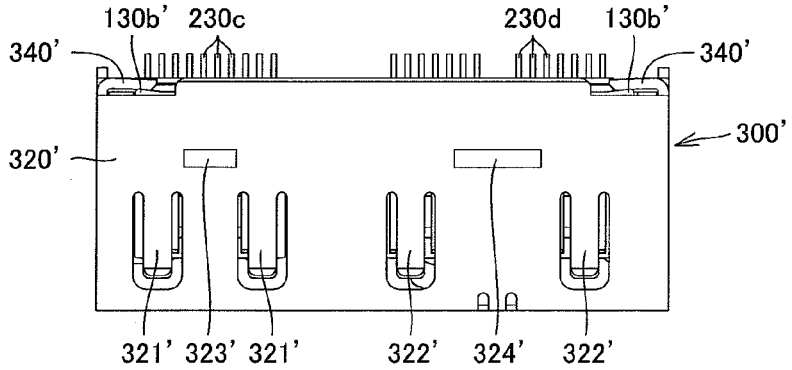
Figure 8D:
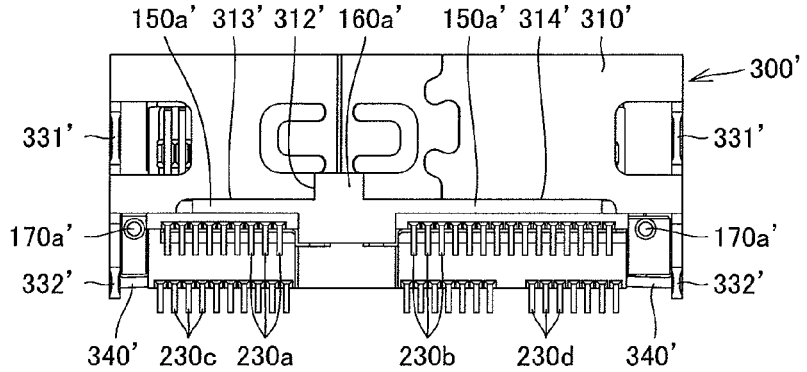
Figure 8E:
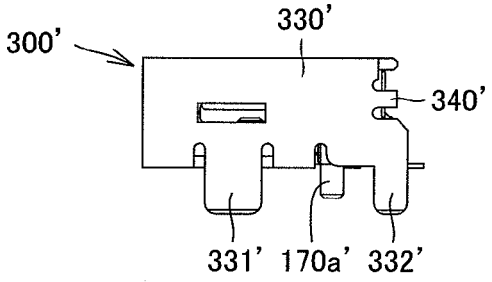
Figure 8F:
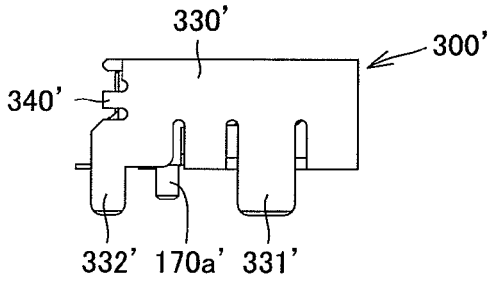
Figure 9A:
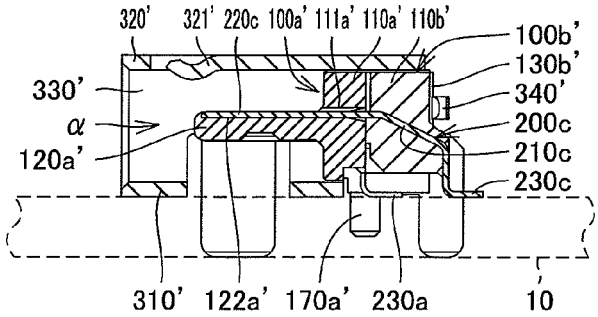
FIG. 9A is a cross-sectional view of the connector along 9A-9A in FIG. 8A.
Figure 9B:
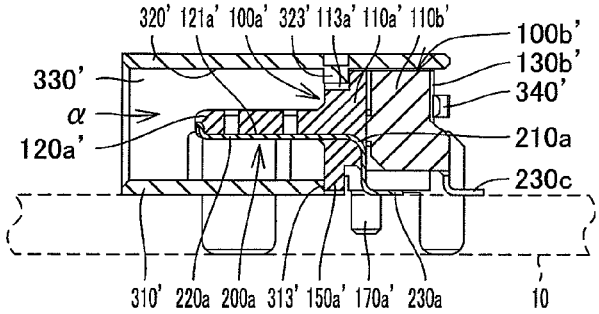
FIG. 9B is a cross-sectional view of the connector along 9B-9B in FIG. 8A.
Figure 9C:
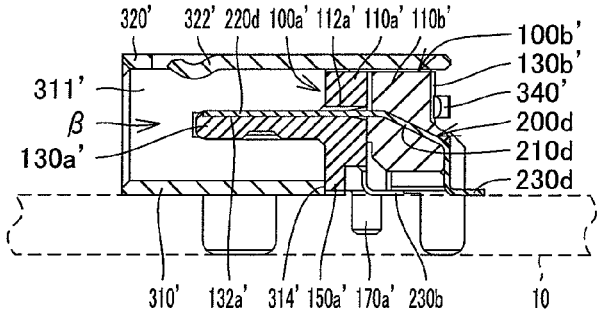
FIG. 9C is a cross-sectional view of the connector along 9C-9C in FIG. 8A.
Figure 9D:
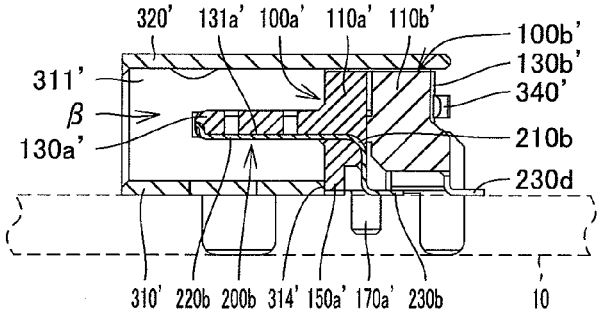
FIG. 9D is a cross-sectional view of the connector along 9D-9D in FIG. 8A.
Figure 9E:
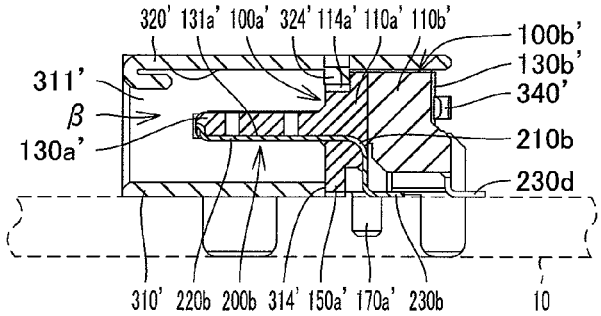
FIG. 9E is a cross-sectional view of the connector along 9E-9E in FIG. 8A.

The top plate 320 is a generally rectangular plate as shown in FIGS. 4 and 5. The top plate 320 are cut at portions to form two locking pieces 321 and two locking pieces 322. Distal ends of the locking pieces 321, 322 are bent downward into circular arcs. When inserting a plug connector 20 or 30 into the first slot α, its connection part 21 or 31 is elastically contacted and held by the distal ends of the locking pieces 321. Similarly, when inserting a plug connector 20 or 40 into the second slot β, its connection part 21 or 41 is elastically contacted and held by the distal ends of the locking pieces 322. Moreover, the top plate 320 are partially cut at portions posterior to the locking pieces 321, 322 and depressed downward to form abutting-stops 323, 324.

A lower end of each of the side plates 330 is provided with a front leg 331 and a rear leg 332 that are piece members extended downward. The front legs 331 are formed by partly cutting opposite widthwise end portions of the bottom plate 310 and bending these cut parts downward. The rear legs 332 are formed by cutting and bending downward portions of the cut-away area of the bottom plate 310, which portions are reserved before cutting away the cut-away area to make the depth dimension of the bottom plate 310 shorter than the top plate 320 and the side plates 330. The front legs 331 and the rear legs 332 are to be inserted into through-holes (not shown) of the circuit board 10 for electrical connection with ground lines of the circuit board 10.

Figure 2A:
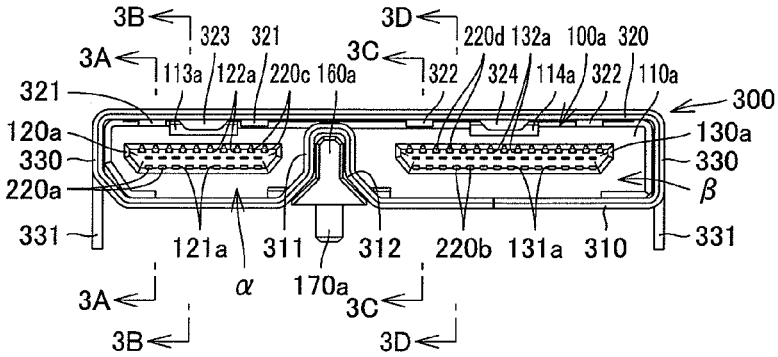
FIGS. 2A to 2F are schematic views of the connector, FIG. 2A being a front view, FIG. 2B being a back view, FIG. 2C being a plan view, FIG. 2D being a bottom view, FIG. 2E being a right side view, and FIG. 2F being a left side view.
Figure 2B:
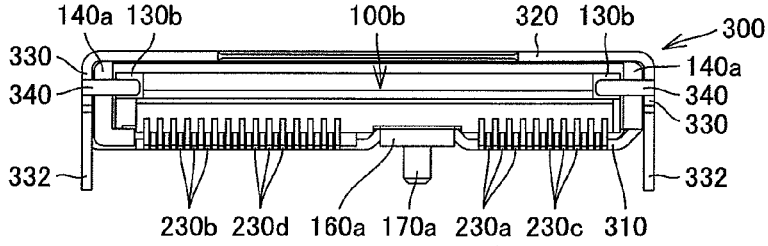
Figure 2C:
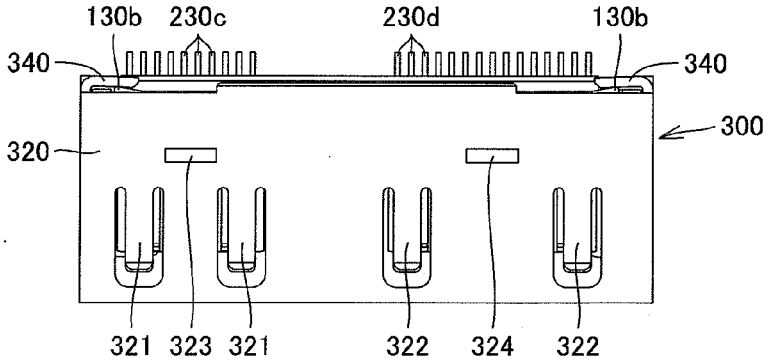
Figure 2D:
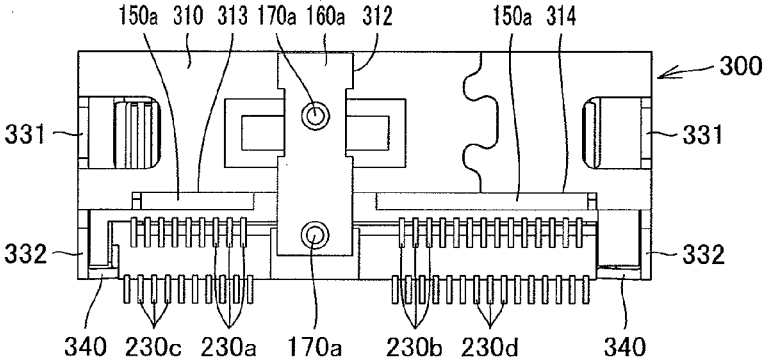
Figure 2E:
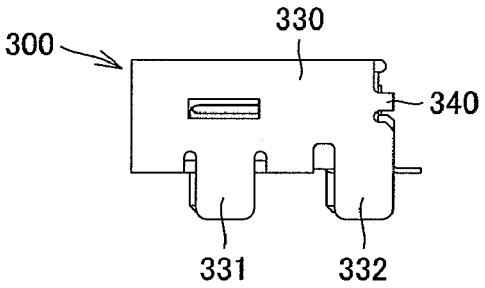
Figure 2F:
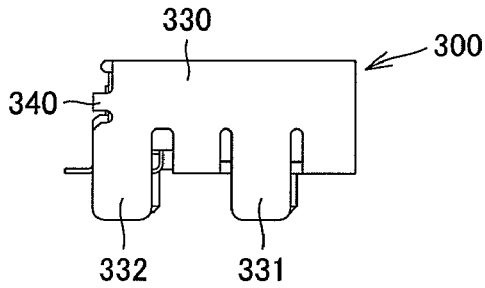

The first body 100*a* is an injection-molded article of insulating resin. The first body 100*a* has a main body 110*a*, first and second projected portions 120*a*, 130*a*, a pair of guides 140*a*, the pair of elongated protrusions (protruded portions) 150*a*, a positioning protrusion 160*a*, and a pair of locking projections 170*a*, as shown in FIGS. 3A to 5. The main body 110*a* is a plate having a rectangular cross-section. The main body 110*a* has a plurality of first and second holes 111*a*, 112*a* formed through the thickness of the main body 110*a* and arranged at spaced intervals in a row along the width of the first body 100*a*. Moreover, depressions 113*a*, 114*a* are provided in an upper end portion of a front surface of the main body 110*a*. The depressions 113*a*, 114*a* are adapted to receive the abutting-stops 323, 324 of the shield case 300, so that the abutting-stops 323, 324 abut back surfaces of the depressions 113*a*, 114*a* from the front side. Moreover, the plate-like first and second projected portions 120*a*, 130*a* to be inserted into the first and second slots α, β are provided in the front surface of the main body 110*a*. The first and second projected portions 120*a*, 130*a* have such outer shapes as to fit in connection holes (not shown) of the connection parts 21, 22 of the plug connector 20 shown in FIG. 6A. The lower surfaces of the first, second projected portions 120*a*, 130*a* has a plurality of first and second long grooves 121*a*, 131*a* at spaced intervals in a row in the width direction. The upper surfaces of the first and second projected portions 120*a*, 130*a* has a plurality of third and fourth long grooves 122*a*, 132*a* at spaced intervals in a row in the width direction, in communication with the first and second holes 111*a*, 112*a*, respectively. The first, second, third and fourth long grooves 121*a*, 131*a*, 122*a*, 132*a* extend in the thickness direction (i.e., in the insertion direction D). Each of the third long grooves 122*a* is located in plan position between adjacent first long grooves 121*a*. Each of the fourth long grooves 132*a* is located in plan position between adjacent second long grooves 131*a*. In other words, as shown in FIG. 2A, the first long grooves 121*a* and the third long grooves 122*a* are arranged in a zigzag manner, and the second long grooves 131*a* and the fourth long grooves 132*a* are arranged in a zigzag manner.

The positioning protrusion 160*a* of generally L-shape is provided centrally at a lower end of the front surface of the main body 110*a*. The positioning protrusion 160*a* has an arm 161*a* and a projection 162*a*. The arm 161*a* is a generally triangular prism extending forward from the front of the main body 110*a*. The projection 162*a* is a rectangular prism projected upward from the distal end of the arm 161*a*. The projection 162*a* is fitted in the upper depression 312*a* of the positioning depression 312 of the shield case 300, and the arm 161*a* is fitted in the lower depression 312*b* of the positioning depression 312. The first body 100*a* is thus fixedly positioned so as not to move in the upward or width directions inside the accommodating space of the shield case 300. The pair of columnar locking projections 170*a* is provided on the lower surface of the arm 161*a*. The locking projections 170*a* are to be inserted into and locked against locking holes (not shown) of the circuit board 10.

Figure 3A:
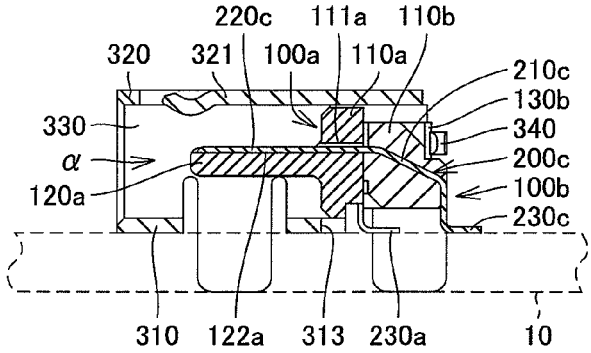
FIG. 3A is a cross-sectional view of the connector along 3A-3A in FIG. 2A.
Figure 3B:
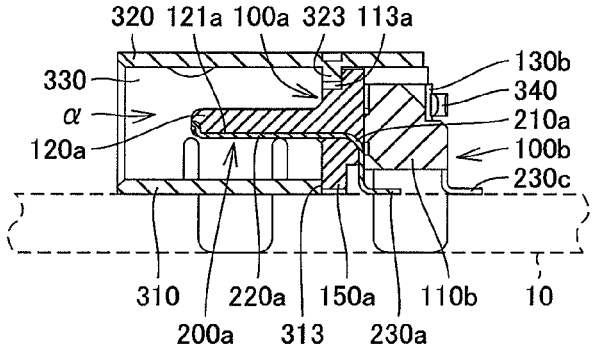
FIG. 3B is a cross-sectional view of the connector along 3B-3B in FIG. 2A.
Figure 3C:
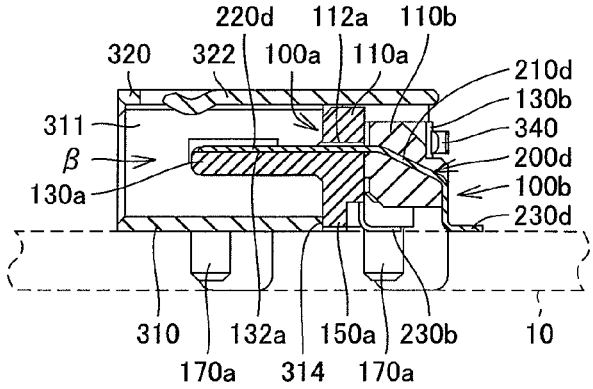
FIG. 3C is a cross-sectional view of the connector along 3C-3C in FIG. 2A.
Figure 3D:
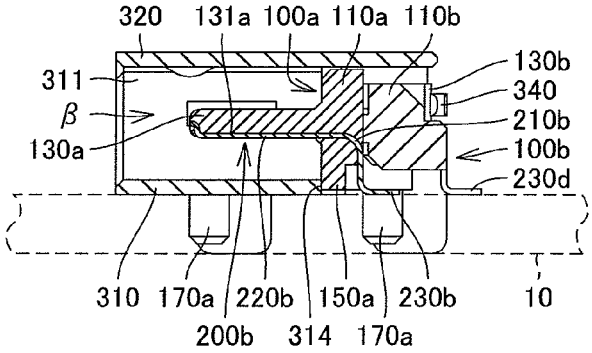
FIG. 3D is a cross-sectional view of the connector along 3D-3D in FIG. 2A.

As shown in FIG. 5, in the main body 110*a*, the plurality of first and second contacts 200*a*, 200*b* are arrayed at spaced intervals in a row in the width direction. Each of the first contacts 200*a* is a conductive elongated metal plate as shown in FIG. 3B and has an embedded portion 210*a*, a contact portion 220*a* and a tail portion 230*a*. The embedded portion 210*a* is a generally inverted L-shaped and embedded in the main body 110*a*, and a rear end portion thereof is projected downward from the main body 110*a*. The contact portion 220*a* extends straight continuously from a distal end (one end in a length direction) of the embedded portion 210*a* and is received in one of the first long grooves 121*a* of the first projected portion 120*a*. The tail portion 230*a* is a flat plate continuing to a rear end (the other end in the length direction) of the embedded portion 210*a*. Each of the second contacts 200*b* is a conductive elongated metal plate as shown in FIG. 3D and has an embedded portion 210*b*, a contact portion 220*b*, and a tail portion 230*b*. The second contacts 200*b* are the same as the first contacts 200*a*, except that the contact portions 220*b* are to be received in the second long grooves 131*a* of the second projected portion 130*a*. As such, the respective portions of the second contacts 200*b* will not be further described with regard to overlap with the first contacts 200*a*. The pair of elongated protrusions 150*a* is provided on the lower surface of main body 110*a*. The protrusions 150*a* abut the abutting-stop surfaces 313, 314 of the bottom plate 310 of the shield case 300 from the front side. The pair of guides 140*a* is provided at the widthwise ends of a rear surface of the main body 110*a*. The guides 140*a* abut the top plate 320 of the shield case 300, improving the degree of parallelism of the combined first and second bodies 100*a* and 100*b* in relation to the top plate 320 of the shield case 300. As shown in FIG. 5, the rear surface of the main body 110*a* has fitting holes 115*a*, one between the first and second holes 111*a* and 112*a* and the other outside the second holes 112*a*.

The second body 100*b* is an injection-molded article of insulating resin, as shown in FIGS. 3A to 5. The second body 100*b* has a main body 110*b*, a pair of fitting projections 120*b*, and a pair of hills 130*b*. The main body 110*b* has a generally L-shaped cross-section, and its width is a little smaller than a distance between the guides 140*a* of the first body 100*a*. When the second body 100*b* is inserted between the guides 140*a*, the first and second bodies 100*a*, 100*b* are combined anteroposteriorly in the insertion direction D. As shown in FIG. 4, the front surface of the main body 110*b* has the pair of fitting projections 120*b* at corresponding positions to the fitting holes 115*a*. The fitting projections 120*b* are columnar projections to fit in the fitting holes 115*a* of the first body

100*a*. The fit between the fitting projections 120*b* and the fitting holes 115*a* allows the first and second bodies 100*a*, 100*b* to be maintained in a combined state. The pair of hills 130*b* is provided at widthwise ends of a rear surface of the main body 110*b*. The hills 130*b* have enough height for their tips to project rearward from the guides 140*a* of the first body 100*a* with the first and second bodies 100*a*, 100*b* combined. The tips of the hills 130 (i.e. a rear surface of the second body 100*b*) abut the lock pieces 340 of the shield case 300 bent into generally L shapes. As a result, the first and second bodies 100*a*, 100*b* accommodated in the accommodating space of the shield case 300 are securely sandwiched between the lock pieces 340 and front abutting portions (namely, the partition 311 and the abutting-stop surfaces 313, 314 of the bottom plate 310, and the abutting-stops 323, 324 of the top plate 320). The first and second bodies 100*a*, 100*b* are thus fixed inside the accommodating space. It is appreciated that FIGS. 4 and 5 illustrates the lock pieces 340 in a straightened state before bent.

In the main body 110*b*, as shown in FIG. 4, the plurality of third and fourth contacts 200*c*, 200*d* are arrayed in a row in the width direction and at the same spaced intervals as those of the first and second holes 111*a*, 112*a*, respectively. The third and fourth contacts 200*c*, 200*d* are located above the first and second contacts 200*a*, 200*b* (i.e., at a different height position). Each of the third contacts 200*c* is a conductive elongated metal plate as shown in FIG. 3A and has an embedded portion 210*c*, a contact portion 220*c*, and a tail portion 230*c*. The embedded portion 210*c* is embedded in the main body 110*b* and has an obliquely inclined intermediate portion, and a distal portion bent with respect to the intermediate portion, and a rear portion bent with respect to the intermediate portion and extended downward. The distal portion and the intermediate portion of the embedded portion 210*c* are embedded in the main body 110*b*. The rear end portion of the embedded portion 210*c* projects downward from the main body 110*b*. The contact portion 220*c* is a flat plate continuing to the distal end (one end in a length direction) of the embedded portion 210*c* and projecting from the front surface of the main body 110*b*. The contact portion 220*c* is longer than the first contact portion 220*a* by a thickness of the main body 110*a* of the first body 100*a*. The contact portion 220*c* is to be received in one of the first holes 111*a* and one of the third long grooves 122*a* of the first body 100*a*. The tail portion 230*c* is a flat plate continuing to a rear end (the other end in the length direction) of the embedded portion 210*c*. Each of the fourth contacts 200*d* is a conductive elongated metal plate as shown in FIG. 3C and has an embedded portion 210*d*, a contact portion 220*d*, and a tail portion 230*d*. The fourth contacts 200*d* are the same as the third contacts 200*c*, except that the contact portions 220*d* are to be received in the second holes 112*a* of the first body 100*a* and in the fourth long groove 132*a* of the second projection 130*a*. As such, the respective portions of the fourth contacts 200*d* will not be further described with regard to overlap with the third contacts 200*c*.

The contact portions 220*a* received in the first long grooves 121*a* and the contact portions 220*c* received in the third long grooves 122*a* are arranged in a zigzag manner. In other words, each of the contact portions 220*c* of the third contacts 200*c* is at a plan position between adjacent ones of contact portions 220*a* of the first contacts 200*a*. The contact portions 220*a*, 220*c* thus arranged are inserted into the first slot α together with the first projected portion 120*a*, in a contactable manner with lower and upper contacts of the connection part 21 or 31 of a plug connector 20 or 30 inserted into the first slot α. Similarly, the contact portions 220*b* received in the second long grooves 131*a* and the contact portions 220*d* received in the fourth long grooves 132*a* are arranged in a zigzag manner. In other words, each of the contact portions 220*d* of the fourth contacts 200*d* is at a plan position between adjacent ones of the contact portions 220*b* of the second contacts 200*b*. The contact portions 220*b*, 220*d* thus arranged are inserted into the second slot β together with the second projected portion 130*a*, in a contactable manner with lower and upper contacts of the connection part 22 or 41 of a plug connector 20 or 40 inserted into the second slot β. Moreover, lower surfaces of the tail portions 230*a*, 230*c* are at the same height, and the tail portions 230*a*, 230*c* are arrayed in two anteroposterior rows in the insertion direction D. Also, lower surfaces of the tail portions 230*b*, 230*d* are at the same height, and the tail portions 230*b*, 230*d* are arrayed in two anteroposterior rows in the insertion direction D. The tail portions 230*a*, 230*b*, 230*c*, 230*d* are connected to associated electrodes (not shown) of the circuit board 10 by soldering.

The receptacle connector having the above-described configuration may be assembled in the following steps. First, as shown in FIGS. 4 and 5, the embedded portions 210*a*, 210*b* of the first and second contacts 200*a*, 200*b* are embedded in the first body 100*a* by insert molding, and the embedded portions 210*c*, 210*d* of the third and fourth contacts 200*c*, 200*d* are embedded in the second body 100*b* by insert molding. The embedded first and second contacts 200*a*, 200*b* will be arrayed in a row in the width direction in the first body 100*a*, and the embedded third and fourth contacts 200*c*, 200*d* will be arrayed in a row in the width direction in the second body 100*b*. At this time, the contact portions 220*a*, 220*b* of the first and second contacts 200*a*, 200*b* are inserted into the first and second long grooves 121*a*, 131*a* of the first body 100*a*.

Thereafter, the first and second bodies 100*a*, 100*b* are brought relatively closer to each other, and the contact portions 220*c*, 220*d* of the third and fourth contacts 200*c*, 200*d* of the second body 100*b* are inserted into the first and second holes 111*a*, 112*a* and the third and fourth long grooves 122*a*, 132*a* of the first body 100*a*. As a result, the contact portions 220*a* and the contact portions 220*c* are arranged at the different height positions in a zigzag manner, and the contact portions 220*b* and the contact portions 220*d* are arranged at the different height positions in a zigzag manner. Simultaneously, the second body 100*b* is inserted between the pair of guides 140*a* of the first body 100*a*, using the guides 140*a* of the first body 100*a* to guide the widthwise ends of the second body 100*b*. The fitting projections 120*b* of the second body 100*b* are fitted in the fitting holes 115*a* of the first body 100*a*. Consequently, the first and second bodies 100*a*, 100*b* are combined anteroposteriorly in the insertion direction D, so that the tail portions 230*a*, 230*c* are arranged at the same height in two anteroposterior rows in the insertion direction D, and the tail portions 230*b*, 230*d* are arranged at the same height in two anteroposterior rows in the insertion direction D.

Thereafter, the positioning protrusion 160*a* of the first body 100*a* is inserted into the positioning depression 312 of the shield case 300, to fit the projection 161*a* of the positioning protrusion 160*a* in the upper depression 312*a* of the positioning depression 312 and the arm 162*a* thereof in the lower depression 312*b*. During this insertion, the positioning protrusion 160*a* is guided by the positioning depression 312 in the insertion direction D, and the first and second bodies 100*a*, 100*b* are received between the lock pieces 340 as straightened along the side plates 330. The first and second bodies 100*a*, 100*b* are inserted from the rear side along the insertion direction D into the accommodating space of the shield case 300 while the widthwise ends of the first body 100*a* are guided by the lock pieces 340, and the first and second projected portions 120*a*, 130*a* of the first body 100*a* are inserted into the first and second slots α, β of the shield case 300. Consequently, the front surface of the main body 110*a* of the first body 100*a* abuts the partition 311; the elongated protrusions 150*a* of the first body 100*a* abut the respective abutting-stop surfaces 313, 314 of the bottom plate 310 of the shield case 300; and the abutting-stops 323, 324 of the top plate 320 of the shield case 300 are received from the front side into the depressions 113*a*, 114*a* of the first body 100*a* and abut the back surfaces of the depressions 113*a*, 114*a*. The guides 140*a* of the first body 100*a* abut the top plate 320 of the shield case 300.

In this state, the lock pieces 340 are bent inward to abut the respective hills 130*b* of the second body 100*b*. Consequently, the first and second bodies 100*a*, 100*b* are securely sandwiched between the lock pieces 340 and the front abutting portions, so that the first and second bodies 100*a*, 100*b* are fixedly accommodated in the accommodating space of the shield case 300.

The receptacle connector may be thus assembled and may be mounted on the circuit board 10 in the following manner. First, the front legs 331 and the rear legs 332 of the shield case 300 are inserted into the through-holes of the circuit board 10. Simultaneously, the locking projections 170*a* of the first body 100*a* are inserted into and locked against the locking holes of the circuit board 10. Consequently, the tail portions 230*a*, 230*b*, 230*c*, 230*d* are placed on the electrodes of the circuit board 10. Thereafter, the front legs 331 and the rear legs 332 are connected by soldering to the through-holes of the circuit board 10, and the tail portions 230*a*, 230*b*, 230*c*, 230*d* are connected by soldering to the electrodes of the circuit board 10.

In the above-described receptacle connector, the partition 311 partitions the internal space of the shield case 300 into the first and second slots α, β, which are adapted to receive and be connected with connection parts of two types, namely for HDMI-mini and for HDMI, of a plug connector/plug connectors. As two types of receptacle connectors are thus integrated into the present connector, it is possible to reduce a mounting space on the circuit board 10 as compared with a case where two types of separate receptacle connectors are used, and it is also possible to reduce the number of components and assembling man-hours. In addition, the present connector is free from the problem of unevenness in mounting position on the circuit board 10 that is likely to arise when mounting two types of separate receptacle connectors.

Moreover, the first and second contacts 200*a*, 200*b* are embedded in the first body 100*a*, and the third and fourth contacts 200*c*, 200*d* are embedded in the second body 100*b*. When combining the first and second bodies 100*a*, 100*b* anteroposteriorly in the insertion direction D, the first contacts 200*a* and the third contacts 200*c* are arranged at the different height positions in a zigzag manner, and the second contacts 200*b* and fourth contacts 200*d* are arranged at the different height positions in a zigzag manner. Accordingly, even when the present connector is downsized, the first body 100*a* can have enough thickness to embed therein and hold the first and second contacts 200*a*, 200*b* and the second body 100*b* can have enough thickness to embed therein and hold the third and fourth contacts 200*c*, 200*d*, so that it is possible to array with high accuracy the first and second contacts 200*a*, 200*b* in the first body 100*a* and the third and fourth contacts 200*c*, 200*d* in the second body 100*b*.

Further, it is advantageously easy to fix the first and second bodies 100*a*, 100*b* in position inside the accommodating space of the shield case 300 because the first and second bodies 100*a*, 100*b* are securely sandwiched between the lock pieces 340 and the front abutting portions of the shield case 300, and the partition 311 and the abutting-stop surfaces 313, 314 of the bottom plate 310 and the abutting-stops 323, 324 of the top plate 320. It is therefore possible to avoid the displacement of the first and second bodies 100*a*, 100*b* inside the shield case 300 and thereby ensure accuracy in positioning the first, second, third, and fourth contacts 200*a*, 200*b*, 200*c*, 200*d*. It is also advantageously easy to incorporate the first and second bodies 100*a*, 100*b* in the shield case 300 because the combined first and second bodies 100*a*, 100*b* are simply inserted into the accommodating space of the shield case 300 from the rear side to bring the front surface of the first body 100*a* into abutment with the partition 311 of the shield case 300 and then the lock pieces 340 are simply bent to abut the rear surface of the second body 100*b*. Moreover, as the pair of fitting projections 120*b* is fitted into the pair of fitting holes 115*a*, the present connector is advantageous with improved flatness, closer to perfect flatness, of the lower surfaces of the tail position 230*a*, 230*b*, 230*c*, 230*d* when the first and second bodies 100*a*, 100*b* are combined. Further, as the locking projections 170*a* of the first body 100*a* are locked in the locking holes of the circuit board 10, it is possible to improve relative positioning accuracy of the first and second slots α, β with respect to a plug receiving port of a housing of the electronic equipment, preventing undue stress from being applied to the connector due to axial deviation in receiving plug connectors.

Second Embodiment

Next, a receptacle connector according to the second embodiment of the present invention will be described with reference to FIGS. 6A to 11. Similarly to the receptacle connector of the first embodiment, the receptacle connector shown in FIGS. 7A to 8F is compliant with the HDMI (High-Definition Multimedia Interface) standard, to be mounted on the circuit board 10 of electronic equipment, such as a television receiver, and used as an external interface of the electronic equipment. This receptacle connector is substantially the same as the receptacle connector of the first embodiment, except that first and second bodies 100*a*' and 100*b*' and a shield case 300' have different shapes from those of the first and second bodies 100*a*, 100*b* and of the shield case 300. Descriptions made hereinafter focus on the differences, not on overlapping features. It is to be noted that elements of the first and second bodies and the shield case are introduced with reference numerals added with an apostrophe (') to distinguish them from the elements of the first and second bodies and the shield case of the first embodiment.

The shield case 300' is different from the shield case 300 of the first embodiment in shapes of a partition 311' and a positioning depression 312' of a bottom plate 310'. Descriptions made hereinafter focus on the differences. As shown in FIGS. 7A to 11, the bottom plate 310' is bent at a central portion thereof into an inverted Y shape. The central portion serves as the partition 311' having a inverted Y-shaped cross section, which partitions an internal space of the shield case 300' into the first and second slots α, β. An outer surface of the central portion forms a positioning depression 312' having a substantially triangular cross section and extending in the insertion direction D. FIGS. 7A to 11 also illustrate a top plate 320', side plates 330', lock pieces 340', locking pieces 321' and 322', abutting-stops 323' and 324' front legs 331', and rear legs 332'.

Figure 10:
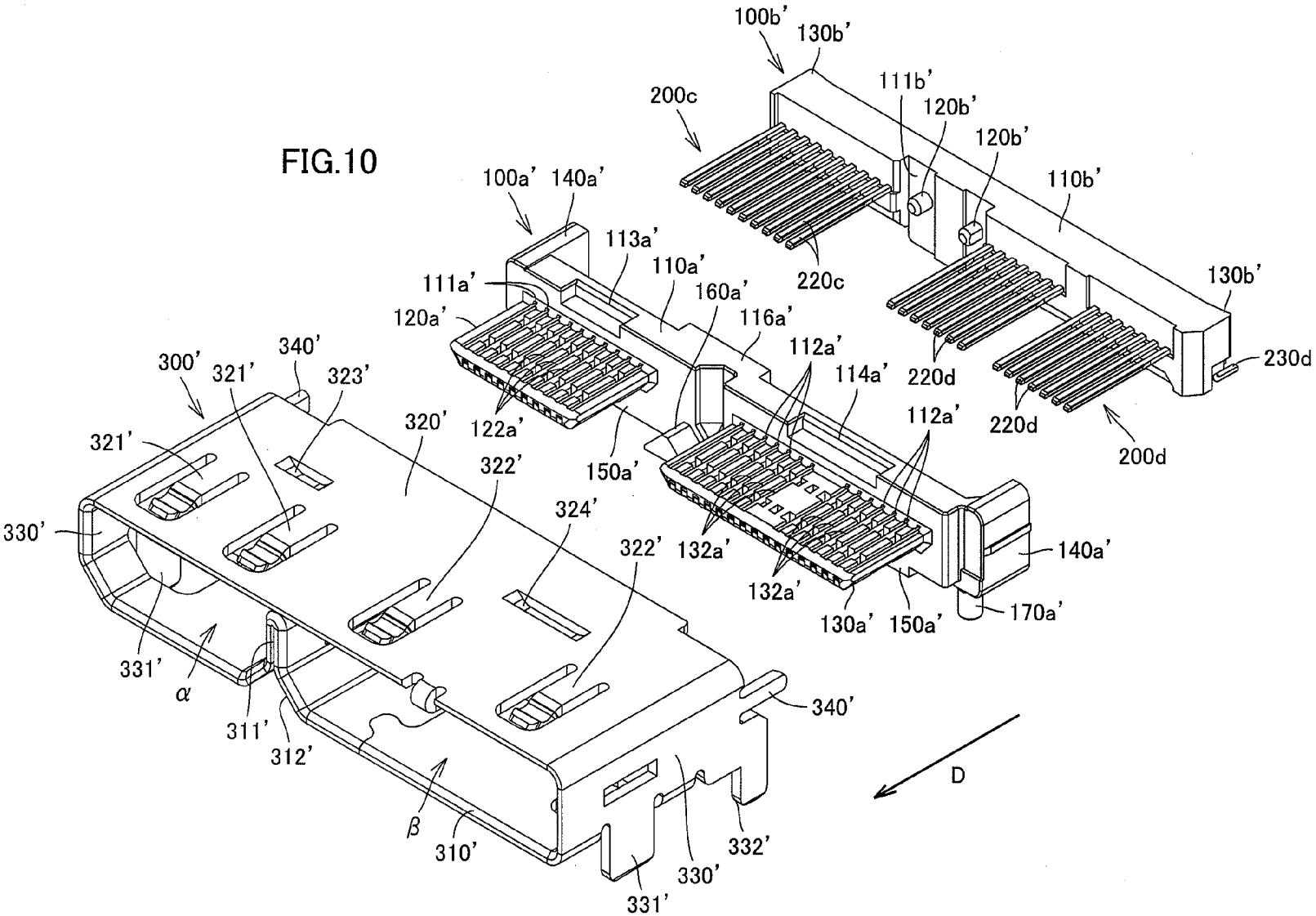
FIG. 10 is an exploded perspective view when the connector is seen from the front, plan and right side.
Figure 11:
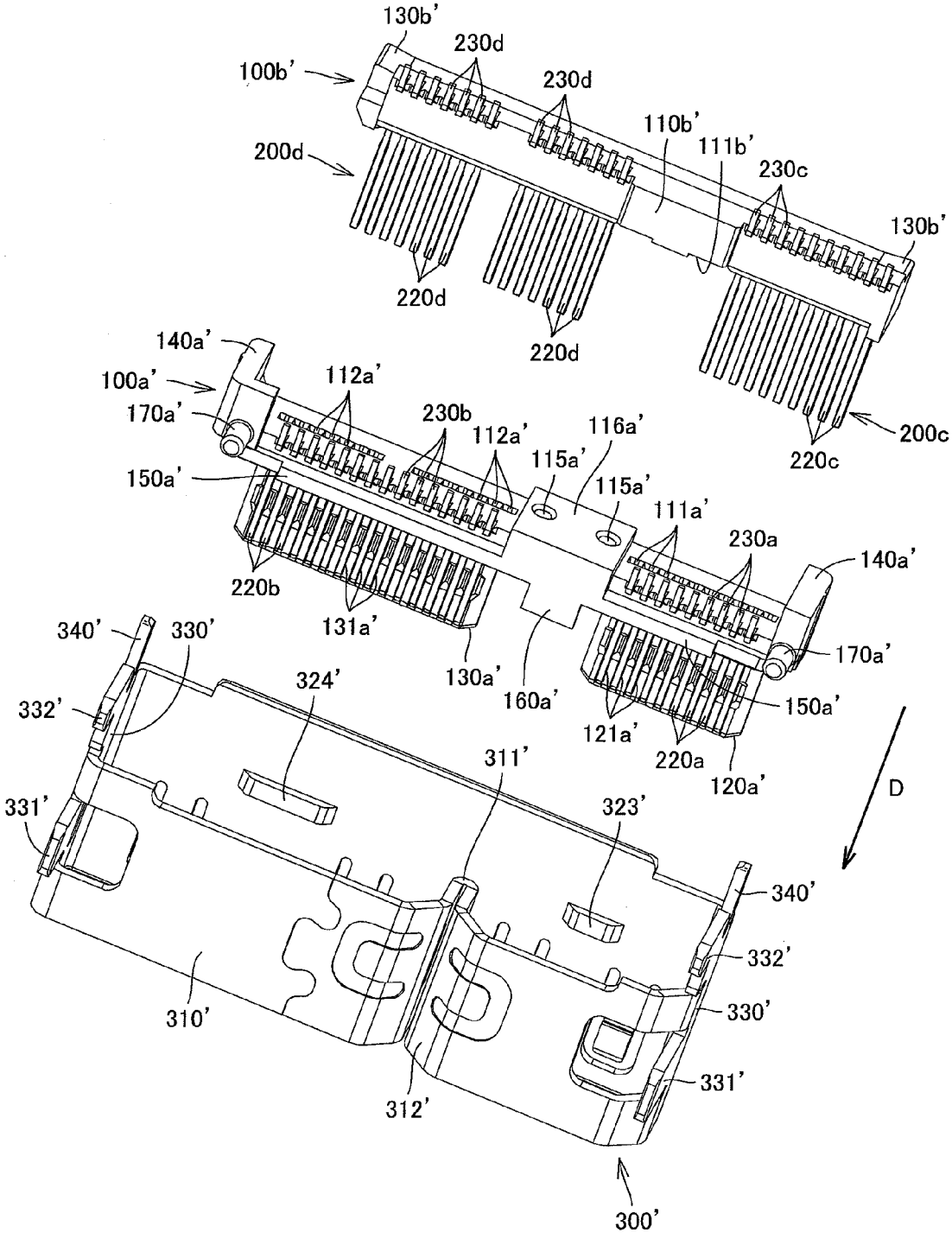
FIG. 11 is an exploded perspective view when the connector is seen from the back, bottom and left side.

The first body 100*a*' is different from the first body 100*a* of the first embodiment in arrays of second holes 112' and fourth long grooves 132' of a main body 110*a*', positions of fitting holes 115*a*' of the main body 110*a*', a newly provided fitting projection 116*a*' in the main body 110*a*' a shape of a positioning protrusion 160*a*', and positions of a pair of locking projections 170*a*'. Descriptions made hereinafter focus on the differences. The main body 110*a* has the second holes 112*a*' and the fourth long grooves 132*a*' arrayed with a wider interval in the middle of each array, as shown in FIGS. 10 and 11. Accordingly, the same wider interval is provided in the middle of the row of the fourth contacts 200*d*, embedded portions 210*d* of which are embedded with the wider interval in the main body 110*b*' of the second body 100*b*'. The positioning protrusion 160*a*' is a generally triangular prismatic arm projected from a front surface of the main body 110*a*'. The positioning protrusion 160*a*' is to be fitted in the positioning depression 312'. The locking projections 170*a*' project from lower surfaces of a pair of guides 140*a*'. The locking projections 170*a*' are to be received and locked in the locking holes (not shown) of the circuit board 10. The fitting projection 116*a*' is a rectangular parallelepiped projection projected in the center of a rear end surface of the main body 110*a*'. The pair of fitting holes 115*a*' is formed in a rear surface of the fitting projection 116*a*'. FIGS. 8 to 11 also illustrate a first projected portion 120*a*', a second projected portion 130*a*', elongated protrusions 150*a*', first holes 111*a*', depressions 113*a*' and 114*a*', first long grooves 121*a*', second long grooves 122*a*', and third long grooves 131*a*'.

The second body 100*b*' is different from the second body 100*b* of the first embodiment in a newly provided fitting depression 111*b*' formed in the center of a front surface of the main body 110*b*' and positions of fitting projections 120*b*'. Descriptions made hereinafter focus on the differences. The fitting depressions 111*b*' are generally rectangular and adapted to fittingly receive the fitting projection 116*a*'. The pair of fitting projections 120*b*' is provided in the bottom of the fitting depression 111*b*'. The fitting projections 120*b*' are to fit in the fitting holes 115*a*' in the rear surface of the fitting projection 116*a*'. The main body 110*b*' and hills 130*b*' abut the top plate 320' of the shield case 300'.

The receptacle connector having the above-described configuration may be assembled in the following steps. First, as shown in FIGS. 10 and 11, the embedded portions 210*a*, 210*b* of the first and second contacts 200*a*, 200*b* are embedded in the first body 100*a*' by insert molding, and the embedded portions 210*c*, 210*d* of the third and fourth contacts 200*c*, 200*d* are embedded in the second body 100*b*' by insert molding. The embedded first and second contacts 200*a*, 200*b* are arrayed in a row in the width direction in the first body 100*a*', and the third and fourth contacts 200*c*, 200*d* are arrayed in a row in the width direction in the second body 100*b*'. Simultaneously, the contact portions 220*a*, 220*b* of the first and second contacts 200*a*, 200*b* are inserted into the first and second long grooves 121*a*', 131*a*' of the first body 100*a*'.

Thereafter, the first and second bodies 100*a*', 100*b*' are brought relatively closer to each other, and the contact portions 220*c*, 220*d* of the third and fourth contacts 200*c*, 200*d* of the second body 100*b*' are inserted into the first and second holes 111*a*', 112*a*' and the third and fourth long grooves 122*a*', 132*a*' of the first body 100*a*'. As a result, the contact portions 220*a* and the contact portions 220*c* are arranged at different height positions in a zigzag manner, and the contact portions 220*b* and the contact portions 220*d* are arranged at the different height positions in a zigzag manner. Simultaneously, the second body 100*b*' is inserted between the pair of guides 140*a*' of the first body 100*a*', using the guides 140*a*' of the first body 100*a*' to guide the widthwise ends of the second body 100*b*'. Consequently, the fitting projection 116*a*' of the first body 100*a*' fits in the fitting depression 111*b*' of the second body 100*b*' and the fitting projections 120*b*' of the second body 100*b*' fits in the fitting holes 115*a*' of the first body 100*a*'. Consequently, the first and second bodies 100*a*', 100*b*' are combined anteroposteriorly in the insertion direction D, so that the tail portions 230*a*, 230*c* are arranged at the same height in two anteroposterior rows in the insertion direction D, and the tail portions 230*b*, 230*d* are arranged at the same height in two anteroposterior rows in the insertion direction D.

Thereafter, the positioning protrusion 160*a*' of the first body 100*a*' is fittingly inserted into the positioning depression 312' of the shield case 300'. During this insertion, the positioning protrusion 160*a*' is guided by the positioning depression 312' in the insertion direction D. The first and second bodies 100*a*', 100*b*' are simultaneously inserted between the lock pieces 340' as straightened along the side plates 330'. At this time, the first and second bodies 100*a*', 100*b*' are inserted from the rear side along the insertion direction D into the accommodating space of the shield case 300' while the widthwise ends of the first body 100*a*' are guided by the lock pieces 340', and the first and second projected portions 120*a*', 130*a*' of the first body 100*a*' are inserted into the first and second slots α, β of the shield case 300'. Consequently, the front surface of the main body 110*a*' of the first body 100*a*' abuts the partition 311'; the elongated protrusions 150*a*' of the first body 100*a*' abut the respective abutting-stop surfaces 313', 314' of the bottom plate 310' of the shield case 300'; and the abutting-stops 323', 324' of the top plate 320' of the shield case 300' are received from the front side in the depressions 113*a*', 114*a*' of the first body 100*a*' and abut back surfaces of the depressions 113*a*', 114*a*'. The guides 140*a*', the main body 110*b*' and the hills 130*b*' abut the top plate 320' of the shield case 300'.

In this state, the lock pieces 340' are bent inward to abut the hills 130*b*' of the second body 100*b*'. Consequently, the first and second bodies 100*a*', 100*b*' are securely sandwiched between the lock pieces 340' and front abutting portions (namely, the partition 311' and the abutting-stop surfaces 313', 314' of the bottom plate 310' and the abutting-stops 323', 324' of the top plate 320'), so that the first and second bodies 100*a*', 100*b*' are fixedly accommodated in the accommodating space of the shield case 300'.

The receptacle connector may be thus assembled and may be mounted on the circuit board 10 in a similar manner to the first embodiment. The locking projections 170*a*' of the first body 100*a*' are inserted into and locked against the locking holes of the circuit board 10.

The above-described receptacle connector produces similar advantageous effects to those of the receptacle connector of the first embodiment.

The above-described receptacle connector is not limited to the above-described embodiment, but may be modified in design within the scope of claims. Hereinafter, modifications are described more in detail.

The shield case according to the first and second embodiments is a conductive metal plate press-molded into a generally rectangular tuboid shape, but any modification in design can be made as long as the shield case is tuboid and has an internal space for accommodating the first and second bodies. For example, the shield case may be formed of insulating resin in a tuboid shape, the outer surface of which may be deposited with metal. Moreover, the central portion of the bottom plate 310/310' in the first and second embodiments are bent to form the partition 311/311' and the positioning depression 312/312', the present invention is not limited thereto. For example, a partition plate prepared separately may be attached to the inside of the shield case to partition the internal space of the shield case into the first and second slots. Moreover, a positioning depression may be provided separately from the partition 311/311' in the bottom plate 310/310' of the shield cases 300/300'. The positioning depression 312/312' in the first and second embodiments extends in the insertion direction D to serve to guide the positioning projection 160*a*/160*a*' of the first body 100*a*/100*a*'. However, the positioning depression may be modified in design can be made as long as it is a hole or a depression provided in the outer surface of the bottom plate of the shield case for fittingly receiving the positioning projection. For example, the positioning depression may be a rectangular or circular hole. Moreover, the lock pieces in the first and second embodiments are provided at the rear ends of the side plates, the present invention is not limited thereto. For example, the lock pieces may be provided at rear end portions of the top plate or the bottom plate of the shield case. Moreover, the lock pieces may be separately provided from the shield case and inserted into holes provided in the shield case so as to abut the rear surface of the second body.

Moreover, the bottom plate of the present invention is not limited to the configurations of the first and second embodiments where the length in the insertion direction D of the bottom plate is shorter than that of the top plate and the side plates. That is, the bottom plate may be of the same length as the top plate and the side plates or may be longer than the top plate and/or the side plates. In the case where the bottom plate is longer than the top plate and/or the side plates, the rear surface(s) of the top plate and/or the side plates, not of the bottom plate, may serve as the abutting-stop surface(s) to abut the front surface of the body. Moreover, the abutting-stops, provided in the top plate in the first and second embodiments, may be provided in the bottom plate and/or the side plates. Moreover, the abutting-stops, formed by cutting portions of the top plate in the first and second embodiments, may be formed in any manner as long as they project toward the internal space of the shield case. The first and second bodies of the invention need to be securely sandwiched at least between the partition and the lock pieces.

The first body in the first and second embodiments has the main body, the first and second projected portions, the pair of guides, the pair of protrusions, the positioning projection, and the pair of locking projections. However, the first body may be modified in design as long as it is adapted to be combined with the second body anteroposteriorly in the insertion direction and has the first and second contacts embedded therein. The positioning projection, having the triangular-prismatic arm in the first and second embodiments, may be modified in design as long as it can be fitted in the above-described positioning depression. Moreover, the abutting-stop surfaces of the shield case of the invention is not limited to the configurations in the first and second embodiments where the abutting-stop surfaces are abutted by the pair of protrusions of the first body. For example, the abutting-stop surfaces may be abutted by the front surface of the main body of the first body or the protruded portions of the first body. Moreover, the protruded portions may be configured to be a single protruded portion. The top plate of the shield case in the first and second embodiments are abutted by the guides of the first body, but the top plate may be abutted by any two points of the first body. The top plate may not be abutted by the first body at all if unnecessary, e.g. in the case where the first body is fixed in its height position in the shield case because of engagement between the positioning projection and the positioning depression.

The second body in the first and second embodiments has the main body, the pair of fitting projections, and the pair of fitting hills. However, the second body may be modified in design as long as it is adapted to be combined with the first body anteroposteriorly in the insertion direction and to embed therein the third and fourth contacts. The lock pieces of the present invention is not limited to the configurations of the first and second embodiments where they are abuttable on the hills. For example, the lock pieces may be abuttable on the rear surface of the second body. In this case, the hills may be omitted. Moreover, the second body in the second embodiment abut the top plate of the shield case at its main body and hills. However, any modification in design can be made as to which portion of the second body should abut the top plate. Alternatively, the second body may not abut the top plate as in the first embodiment. The present connector may be configured with three or more bodies combined anteroposteriorly in the insertion direction.

Figure 12A:
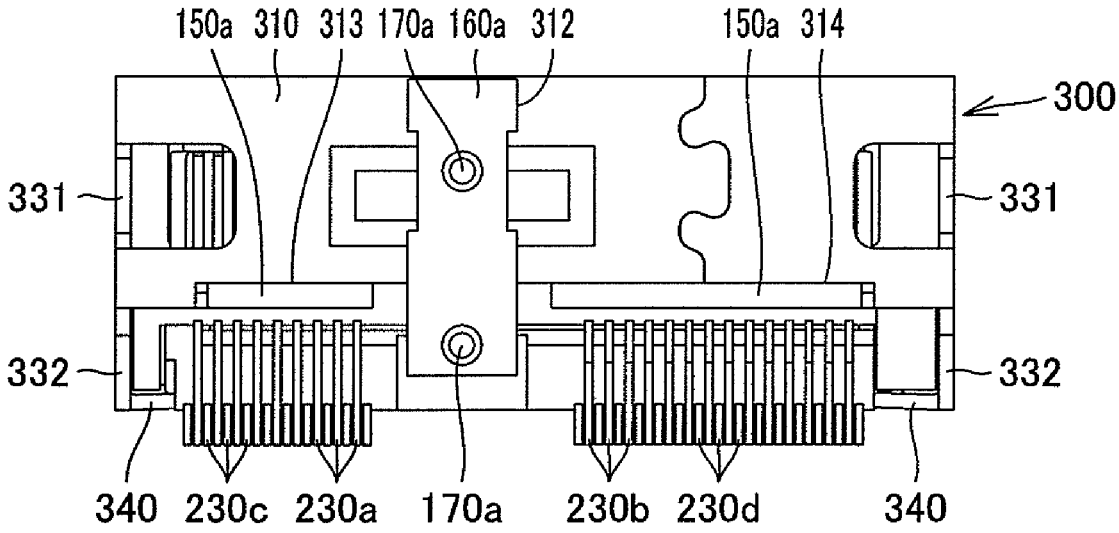
FIGS. 12A and 12B are schematic views illustrating modified connectors, FIG. 12A being a bottom view showing an example in which first, second, third and fourth tail portions are arrayed in a row in a width direction, and FIG. 12B being a cross-sectional view showing an example in which the first, second, third, and fourth tail portions are extended downward.
Figure 12B:
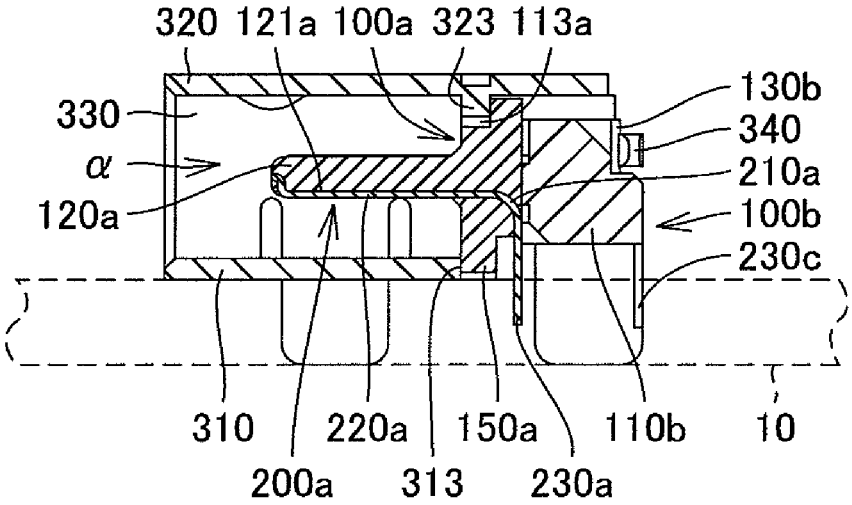

In the first and second embodiments, the first body has the fitting projections and the second body has the fitting holes. However, the first body may have the fitting holes and the second body may have the fitting projections. Obviously, the fitting holes and the fitting projections may be omitted.

the first and second contacts in the first and second embodiments each have the embedded portion, the contact portion and the tail portion. However, the first and second contacts may be modified in design as long as they are embedded in the first body at spaced intervals in the width direction, and as long as they are each partly received in the first slot so as to be contactable with contacts of the mating connector. Moreover, the third and fourth contacts in the first and second embodiments each have the embedded portion, the contact portion and the tail portion. However, the third and fourth may be modified in design as long as they are embedded in the second body at spaced intervals in the width direction, and as long as they are each partly received in the second slot so as to be contactable with contacts of the mating connector. In the first and second embodiments, the tail portions 230*a*, 230*c* are arranged at the same height and in two anteroposterior rows in the insertion direction D, and the tail portions 230*b*, 230*d* are arranged at the same height and in two anteroposterior rows in the insertion direction D. However, as shown in FIG. 12A, the tail portions 230*a*, 230*b* may be made longer so that the tail portions 230*a*, 230*b*, 230*c*, 230*d* are arranged at the same height in a row in the width direction. Alternatively, as shown in FIG. 12B, the tail portions 230*a*, 230*b*, 230*c*, 230*d* may be extended downward and inserted into through-holes in the circuit board 10 for connection by soldering.

Moreover, the connector of the invention may be used as a plug connector. Particularly, instead of connecting the tail portions with the electrodes of the circuit board 10, the tail portions may be connected with lead wires of a cable or with lead wires of a cable via conductive lines connected to the electrodes of the circuit board 10, thereby using the present connector as a plug connector. In this case, the tail portions may be arranged at the same height and in two anteroposterior rows in the insertion direction D, may be arranged at the same height and in a row in the width direction, or may be arranged at different heights. When the connector has three or more bodies as described above, the third body and subsequent bodies may have the contacts arrayed at different heights from those of the first, second, third, and fourth contacts in the width direction.

The materials, shapes, numbers, dimensions etc. of the respective elements of the receptacle connector in the first and second embodiments have been described by way of example only, and the receptacle connector of the invention may be modified in design in any manner as long as they provide similar functions. While the present invention is described in the first and second embodiments as an HDMI receptacle connector, the present invention is not limited thereto. The first and second slots in the first and second embodiments are configured to comply with HDMI-mini and the HDMI standards, but the internal shapes of the first and second slots may be modified in design as needed in accordance with shapes of mating connectors if they are of other types. For example, the first and second slots may have the same internal shapes so as to receive mating connectors of the same type. Further, a plurality of partitions may be provided to partition the internal space of the shield case into three or more. As described above, the present invention is applicable not only to receptacle connectors but also to plug connectors. Moreover, while the television receiver is mentioned above as exemplifying the electronic equipment, the present invention is not limited thereto.

REFERENCE SIGNS LIST

10 circuit board
20 plug connector
21 connection part
22 connection part
30 plug connector
31 connection part
40 plug connector
41 connection part
100*a* first body
110*a* main body
111*a* first hole
112*a* second hole
120*a* first projected portion
121*a* first long groove
122*a* third long groove
130*a* second projected portion
131*a* second long groove
132*a* fourth long groove
140*a* guide
150*a* elongated protrusion (protruded portion)
160*a* positioning projection
100*b* second body
110*b* main body
120*b* fitting projection
130*a* hill
200*a* first contact
210*a* embedded portion
220*a* contact portion
230*a* tail portion
200*b* second contact
210*b* embedded portion
220*b* contact portion
230*b* tail portion
200*c* third contact
210*c* embedded portion
220*c* contact portion
230*c* tail portion
200*d* fourth contact
210*d* embedded portion
220*d* contact portion
230*d* tail portion
300 shield case
310 bottom plate
311 partition
312 positioning depression
313 abutting and stopping surface (rear surface of bottom plate)
314 abutting and stopping surface (rear surface of bottom plate)
320 top plate
323 abutting-stop
324 abutting-stop
330 side plate
340 lock piece

The invention claimed is:

1. A connector comprising:

a tuboid shield case having first and second slots, top and bottom plates, a rear portion, and a lock piece provided at the rear portion, wherein the bottom plate has a central portion of U-shaped cross section that is bent toward the top plate and serves as a partition to partition an internal space of the shield case into the first and second slots, and the central portion has a positioning depression on an outer surface side thereof;

first and second bodies, inserted into the shield case, combined anteroposteriorly in an insertion direction of the first and second bodies, and sandwiched between the partition and the lock piece, wherein the first body has a front face abuttable on the partition and a positioning projection provided on the front face and fittingly engageable with the positioning depression, and the second body has a rear surface abutting the lock piece;

a plurality of first contacts embedded in the first body at spaced intervals in a width direction of the first body, the first contacts each partly being received in the first slot;

a plurality of second contacts embedded in the first body at spaced intervals in the width direction, the second contacts each partly being received in the second slot;

a plurality of third contacts embedded in the second body at spaced intervals in the width direction and at a different height from that of the first contacts, the third contacts each partly being received in the first slot; and a plurality of fourth contacts embedded in the second body at spaced intervals in the width direction and at a different height from that of the second contacts, the fourth contacts each partly being received in the second slot.

2. The connector according to claim 1, wherein a fitting projection is provided in a rear surface of the first body and a fitting depression is provided in a front surface of the second body, or, alternatively, a fitting depression is provided in a rear surface of the first body and a fitting projection is provided in a front surface of the second body, and the fitting projection is adapted to fit in the fitting depression in a state where the first and second bodies are combined.

3. The connector according to claim 1, wherein the shield case further has a pair of side plates, and the bottom plate has a shorter length in the insertion direction than that of the top plate.

4. The connector according to claim 1, wherein the positioning depression extends in the insertion direction and is adapted to guide the positioning projection of the first body when the first body is inserted into the shield case.

5. The connector according to claim 3, wherein a rear surface of the bottom plate is abuttable on the front surface of the first body.

6. The connector according to claim 3, wherein the top plate is provided with an abutting-stop projected toward the bottom plate, and the abutting-stop is abuttable on the first body from a front side of the connector.

7. The connector according to claim 3, wherein the first body are abuttable at least two points on the top plate.

8. The connector according to claim 3, wherein the lock piece comprises lock pieces provided continuously to respective rear ends of the side plates, the lock pieces as extending straight along the side plates are adapted to guide the first and second bodies when being inserted in the shield case, and the lock pieces as bent are abuttable on the rear surface of the second body.

9. The connector according to claim 1, wherein the first body includes:

a main body of generally rectangular shape in cross-sectional view;

first and second projected portions projected from a front surface of the main body and adapted to be received in the first and second slots, respectively; and a protruded portion provided on a lower surface of the main body and abuttable on the rear surface of the bottom plate, first and second long grooves extending in the insertion direction are formed in lower surfaces of the first and second projected portions, respectively, third and fourth long grooves extending in the insertion direction are formed in upper surfaces of the first and second projected portions, respectively, and the main body has first and second holes passing through the main body in the insertion direction and communicating with the third and fourth long grooves, respectively, the third and fourth contacts each have:

an embedded portion that is embedded in the second body;

a contact portion that continues to an lengthwise end of the embedded portion and is received in an associated one of the first and second holes and an associated one of the third and fourth long grooves; and a tail portion that continues to the other lengthwise end of the embedded portion, and the first and second contacts each have:

an embedded portion that is embedded in the main body;

a contact portion that continues to an lengthwise end of the embedded portion and is received in an associated one of the first and second long grooves of the first and second projected portions; and a tail portion that continues to the other lengthwise end of the embedded portion.

10. The connector according to claim 9 comprising a receptacle connector, wherein the tail portions of the first and third contacts are arranged at a same height and in two anteroposterior rows in the insertion direction, and the tail portions of the second and fourth contacts are arranged a same height and in two anteroposterior rows in the insertion direction.

11. The connector according to claim 9 comprising a receptacle connector, wherein the contact portions of the first and third contacts are arranged in a zigzag manner, the contact portions of the second and fourth contacts are arranged in a zigzag manner, and the tail portions of the first, second, third and fourth contacts are arranged at a same height and in a row in the width direction.

12. The connector according to claim 9 comprising a receptacle connector, wherein the tail portions are extended downward.

13. The connector according to claim 1, comprising a receptacle connector mountable on a circuit board, wherein the first body is provided with a locking projection adapted to be locked in a locking hole of the circuit board.

14. Electronic equipment, comprising the connector according to claim 1 as an external interface.

* * * * *